United States Patent [19]

Caveney et al.

[11] 4,135,749

[45] Jan. 23, 1979

[54] CABLE TIE

[75] Inventors: Jack E. Caveney, Hinsdale; Roy A. Moody, Flossmoor, both of Ill.

[73] Assignee: Panduit Corp., Tinley Park, Ill.

[21] Appl. No.: 760,598

[22] Filed: Jan. 19, 1977

[51] Int. Cl.[2] ..... B65D 33/34

[52] U.S. Cl. ..... 292/317

[58] Field of Search ..... 292/316, 317, 318, 321, 292/320, 322; 24/16 PB

[56] References Cited

U.S. PATENT DOCUMENTS

| | | | |
|---|---|---|---|
| 2,977,145 | 3/1961 | Rifkin | 292/321 |
| 3,102,311 | 9/1963 | Martin et al. | 24/16 PB |
| 3,717,906 | 2/1973 | Wells | 24/16 PB |
| 3,952,373 | 4/1976 | Noorily | 24/16 PB |

*Primary Examiner*—Richard E. Moore

*Attorney, Agent, or Firm*—Richard B. Wakely; Charles R. Wentzel

[57] ABSTRACT

A one-piece molded thermoplastic cable tie for forming a plurality of elongate objects into a bundle of generally circular cross-section and for compressively holding a pair of objects in engagement. The tie includes an elongate strap including elongate side rails joined by a thin web with the rails and web substantially symmetrical about a first plane intersecting the rails and web and also substantially symmetrical about a second plane normal to the first and intersecting only the web. A plurality of spaced teeth are disposed on one surface of the web.

A locking head joined to the strap includes an abutment wall, strap entry and exit faces, an aperture extending between the faces, and a locking pawl which in its as-molded position, extends into the aperture and toward the abutment wall and strap exit face. The pawl is movable between a threading position wherein the pawl is out of locking engagement with the strap and a locking position wherein the pawl is disposed adjacent the strap entry face and is in locking engagement with the strap. When the pawl is in its locking position, the strap engages the abutment wall and is held between the wall and the pawl whereby attempted retrograde movement of the strap causes the pawl to more firmly engage the strap.

19 Claims, 7 Drawing Figures

CABLE TIE

BACKGROUND OF THE INVENTION

This invention relates to bundling apparatus and more specifically to a one-piece molded thermoplastic cable tie for forming a plurality of objects into a bundle.

Commercially available one-piece plastic cable ties have excellent performance characteristics when used in moderate to warm temperature environments; however, they have limitations when used in extreme low temperature. This occurs because the strap becomes increasingly brittle with decreasing temperature. Additionally, the presence of teeth on one surface of the strap, as with any discontinuity, has a "notch effect" in that the teeth tend to foster localized stress concentrations at their relatively sharp junctures with the web of the strap when the strap is bent. While such ties can be used at low temperature if handled carefully, severe flexure or shock could result in strap breakage.

Concerning the manufacture of cable ties, one-piece molded theremoplastic cable ties typically include an elongate toothed strap and a locking head joined thereto with one surface of the strap and the head's strap entry face being generally coplanar and with the body of the locking head extending as a cantilever far past the other strap surface. The cavity used for molding the tie is typically formed by a pair of cavity blocks which meet at approximately the longitudinal center line of the strap. When, after completion of molding, the cavity blocks are separated, the tie remains in the block which is in engagement with the head's strap exit face since the head cavity of that block is significantly deeper and has more surface area from which to strip the molded part than the relatively shallow head cavity of the cavity block which engages the strap entry face.

The strap is typically of generally rectangular cross-section and the various walls of the head define a strap-receiving aperture shaped generally complimentary to the strap. It has been found with such a configuration, that two or more knockout pins are normally required to free the tie from the cavity block holding it after the blocks have been opened. The use of several small pins is required because the head's exit face fails to have an impact area sufficiently large to receive the force of a single, larger knockout pin. Using several small pins, while performing satisfactorily, greatly increases the complexity of the cavity blocks and several small pins have a shorter service life than a single larger knockout pin.

SUMMARY OF THE INVENTION

Among the several objects of the invention may be noted the provision of an improved one-piece molded plastic cable tie; the provision of such tie which has improved low temperature performance as the brittleness of the strap is reduced and localized stress concentrations during bending of the strap are decreased; the provision of such tie which decreases the complexity of the cavity blocks required to mold the tie; the provision of such a tie which is neat in appearance and is lightweight; the provision of such tie which securely locks the strap about the objects to be held; the provision of such tie which reduces strap tooth pressure on the bundled objects; and the provision of such tie which is economical and simple to manufacture. Other objects and features will be in part apparent and in part pointed out hereinafter in the description and in the claims.

Briefly, the cable tie of the present invention comprises an elongate strap one end of which is joined to a locking head. The strap includes spaced side rails joined by a thin web and the rails and web are symmetrical about each of a pair of planes normal to one another. One surface of the web has a plurality of spaced transverse teeth disposed thereon. The locking head includes an abutment wall, strap entry and exit faces, a strap-receiving aperture extending between the faces, and a locking pawl extending into the aperture toward the abutment wall and strap exit face. When the tie is locked, the abutment wall engages the strap which is held between the wall and the locking pawl.

BRIEF DESCRIPTION OF THE DRAWINGS

Corresponding reference characters indicate corresponding parts throughout the several view of the drawings.

DESCRIPTION OF THE PREFERRED EMBODIMENT

Figure 1:
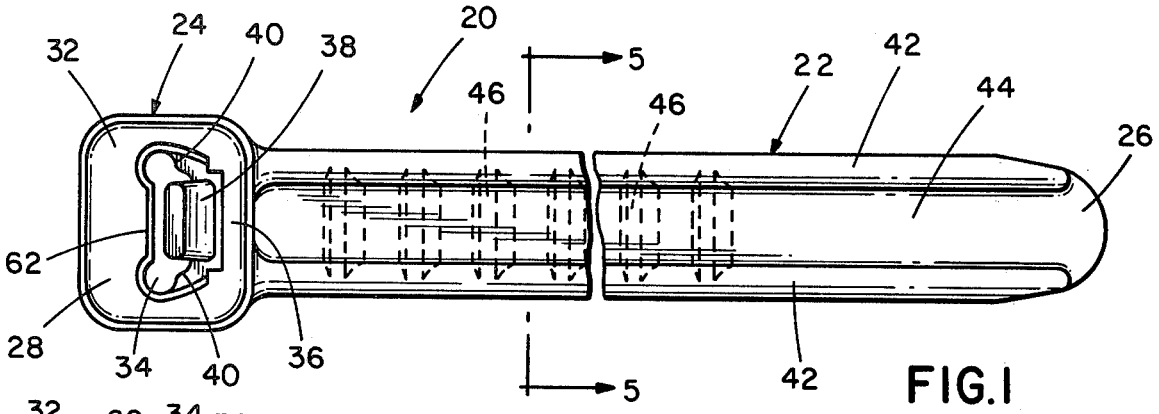
FIG. 1 is a plan of the one-piece cable tie of the present invention which includes a toothed strap and a locking head having a pawl for engaging the strap.

Referring now to the drawings, a one-piece molded thermoplastic cable tie for forming a plurality of objects, such as wires, into a bundle of generally circular cross-section and for holding a pair of objects together is generally indicated in FIG. 1 by reference numeral 20. Tie 20 includes an elongate toothed strap 22 and a locking head 24 joined to one end of strap 22 for receiving the distal end 26 of the strap which is tapered to facilitate insertion.

Figure 6:
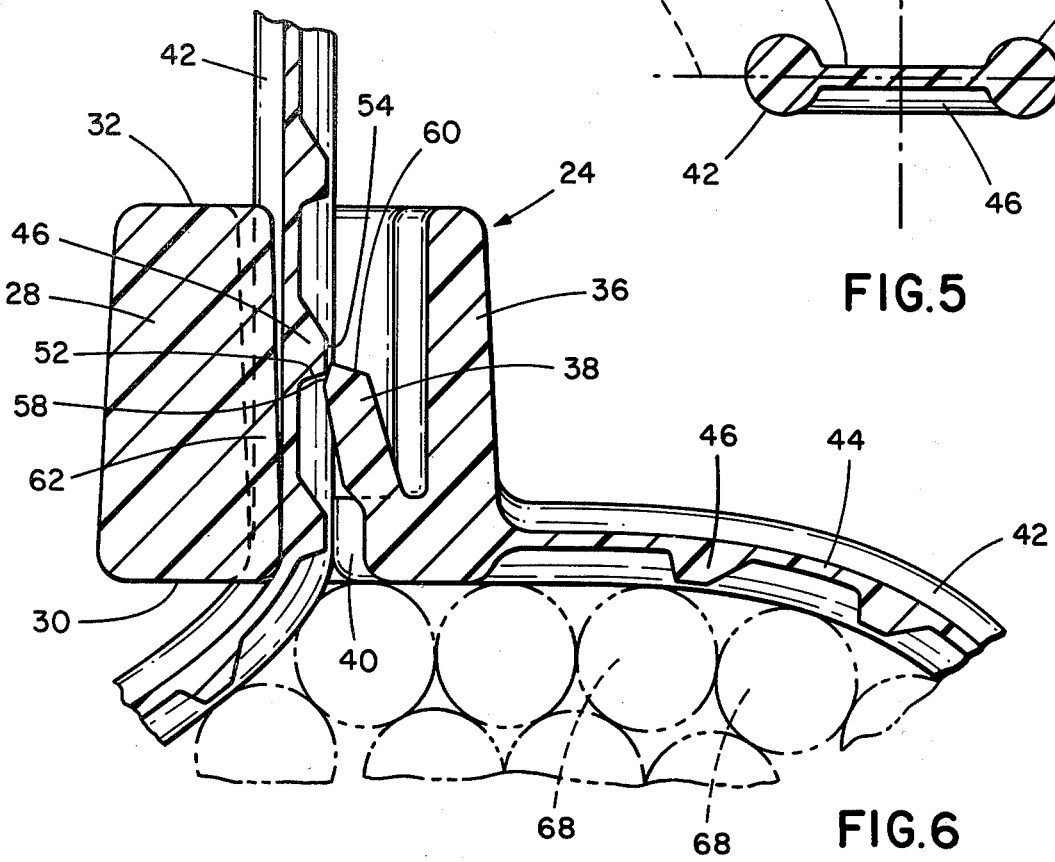
FIG. 6 is an enlarged sectional view showing the strap being threaded into the locking head.

More specifically, head 24 includes an abutment wall 28, a strap entry face 30, a strap exit face 32, and a strap receiving aperture 34 extending between the faces 30 and 32. Head 24 further comprises an end wall 36 which, together with abutment wall 28, partially defines aperture 34. A flexible locking pawl 38 for engaging strap 22 extends from end wall 36 into aperture 34 and towards abutment wall 28 and strap exit face 32. The pawl is movable between a threading position, shown in FIG. 6, wherein it is out of locking engagement with strap 22 and disposed closer to strap exit face 32 than when in its as-molded position, shown in FIG. 2, and a locking position, shown in FIG. 7, wherein it securely engages the strap and is positioned adjacent strap entry face 30. Head 24 further includes a pair of shoulders 40 extending into aperture 34 and straddling pawl 38 for limiting movement of the strap towards the pawl.

Figure 5:
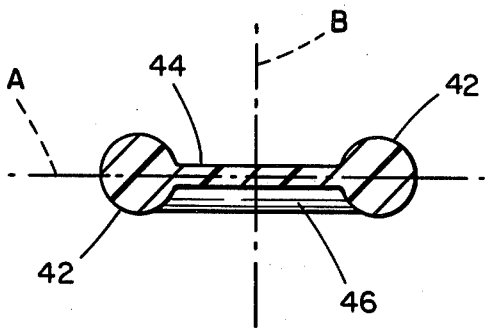
FIG. 5 is a sectional view of the strap taken generally along line 5 — 5 of FIG. 1.

Strap 22 comprises a pair of spaced longitudinal side rails 42 and a relatively thin web 44 disposed intermediate of and joining the rails. As best shown in FIG. 5 rails 44 are generally round in cross section and the web and rails are substantially symmetrical about a first plane A intersecting the web and rails and are also substantially symmetrical about a second plane B spaced ninety degrees from plane A and which intersects web 44 but not rails 42. The use of round side rails decreases the pressure necessary to fill the strap forming cavity defined by the cavity blocks since less pressure is needed to fill a round cavity than one of a different cross-sectional configuration. Also note that the provision of the continuous web of the present invention offers advantages over a so called "ladder strap", for example, as shown in U.S. Pat. No. 3,766,608, in which the side rails are joined only by spaced transverse rungs. More specifically in molding the strap of the present invention, the molding material only need flow in generally the longitudinal direction of the strap to form all the structural features of the strap. For the ladder strap, in which the rungs are spaced by apertures, the material which forms the rungs flows from opposite directions, i.e., from each side rail, which could cause the formation of gas pockets in the rungs which adversely affects rung strength.

Figure 2:
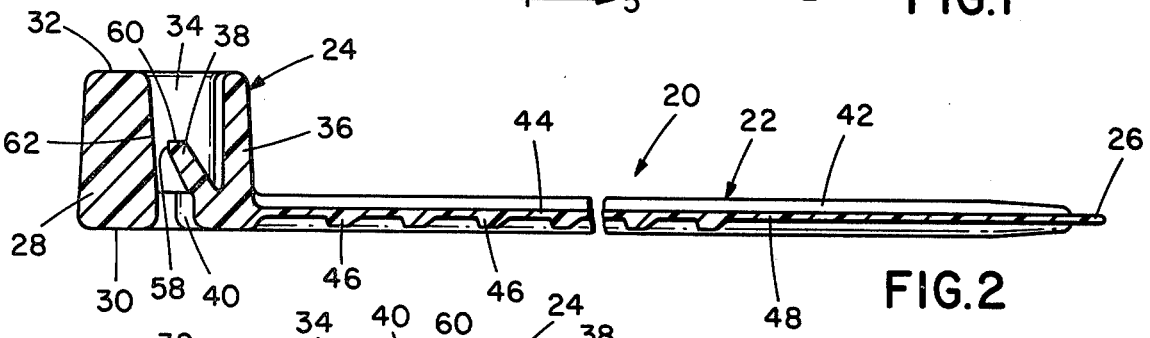
FIG. 2 is a longitudinal cross-sectional view of the tie of FIG. 1.
Figure 4:
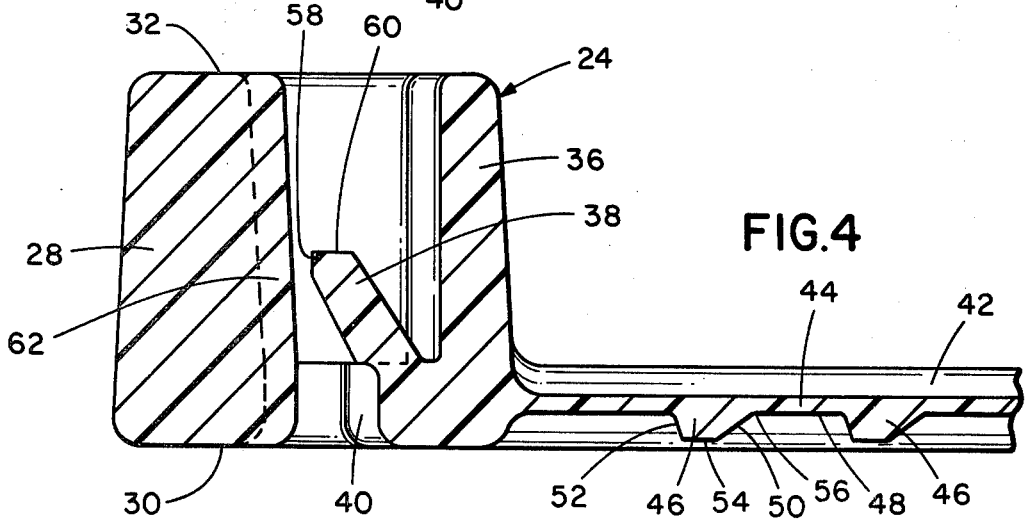
FIG. 4 is an enlarged cross-sectional view of the locking head.

As best shown in FIGS. 2 and 4, a plurality of spaced transverse teeth 46 extend from one surface 48 of web 44 for engaging pawl 38. Teeth 46 join rails 42 and each tooth includes an inclined ramp surface 50 for camming pawl 38 towards its threading position, a generally vertical but slightly inclined abutment surface 52 for securely engaging the pawl upon attempted retrograde movement of the strap through the locking head, and a generally flat crest surface 54 joining ramp surface 50 and abutment surface 52. Adjacent teeth are spaced by a flat portion of web surface 48.

Referring to FIG. 4, pawl 38 includes a generally flat first surface 58 facing abutment wall 28 and a generally flat second surface 60 facing head exit face 32. When pawl 38 is in its locking position strap 22 engages abutment wall 28 and is held between the wall and pawl 38 with the pawl engaging both abutment surface 52 of the held tooth 46 and the web 44.

As the strap 22 is bent from its as-molded position shown in FIGS. 1 and 2, the inside portion of the strap becomes shortened thereby being subjected to compressive stress while the outside portion of the strap becomes elongated and is subject to tensile stress. The strap has a neutral axis along which the strap undergoes no change in length and along which neither tensile nor compressive stresses exist. A good approximation of the neutral axis of strap 22 of the present invention lies in a longitudinal plane through the strap and which includes the center of gravity of the strap. It should be recognized that the magnitude of tensile and compressive stresses occurring in a particular portion of the strap caused by flexure of the strap generally increases in direct proportion to the distance of the strap portion under consideration is spaced from the neutral axis. The presence of teeth on the strap like any discontinuity, has a notch effect, in that they cause localized stress concentrations at the relatively sharp juncture of the teeth with the web. In prior art structure where typically the roots of the strap teeth were significantly spaced from the neutral axis of the strap, the notch effect was pronounced. Of course when used in a low temperature environment, the strap becomes relatively brittle and the presence of teeth having roots remote from the neutral axis of the strap could promote breakage upon impact to a bent strap.

In strap 22 of the present invention, teeth 46 have roots or bases 56 which lie substantially along the neutral axis of the strap thereby greatly reducing the notch effect. Note that the junctures of the teeth and web are rounded. Furthermore, the presence of the flat portions of web surface 48 between adjacent teeth serve to dissipate any localized stress concentrations appearing as the strap is bent to the threaded into head 24. It should further be noted that web 44 is relatively thin as compared to the rails 42 and has sufficient thickness only to support the teeth and prevent teaaring or piercing of the web by the pawl. Decreasing web thickness increases the flexibility of the web thereby adding in reducing the notch effect. Web 44 preferably has a thickness less tnan one quarter of the thickness of rails 42. This reduces the amount of material needed to fabricate the tie and, accordingly, makes the tie very lightweight.

Referring to FIG. 5, also note that strap 22, with its barbell shape in cross-section and with the roots 56 of teeth 46 disposed substantially along the neutral axis of the strap, undergoes less transverse bending during tightening of the tie than a strap U-shaped in cross-section, i.e. similar to FIG. 5 but with the web moved upwardly to terminate flush with the top of the rails. As shown in FIG. 4, rails 42 preferably extend past the crests of teeth 46. This feature not only protects the teeth from damage, but as the teeth face the bundled objects, tooth pressure on the objects is reduced.

Figure 3:
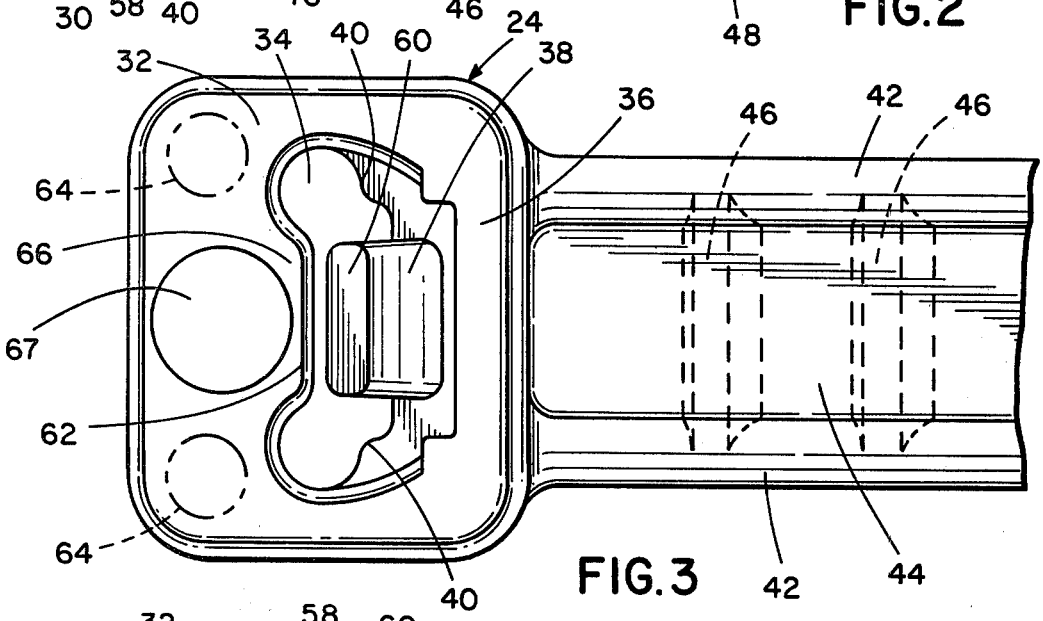
FIG. 3 is an enlarged plan view of the locking head.

Referring to FIGS. 1 and 3, abutment wall 28 of head 24 includes a tongue 62 extending into aperture 34 toward pawl 38 and dividing the aperture into a narrowed central portion for receiving the web 44 and end portions, shaped generally complimentary to rails 42, for receiving the rails. One-piece cable ties are typically formed by a pair of cavity blocks defining a molding cavity and meeting at about the longitudinal center line of the strap. When the blocks are opened, the molded tie is retained in the block engaging the strap exit face of the locking head as that block has the deepest head cavity portion. It is customary to then release the tie by the use of cylindrical knockout pins slidably carried by the block. Heretofore, it was common practice to use at least two knockput pins because the surface of the strap exit face had insufficient impact area to receive the blow of a single knockout pin without damage to the locking head. Typical impact areas for prior art ties are shown by the dashed circles 64 in FIG. 3. In the locking head 24 of the present invention, tongue 62 includes an impact surface 66 coplanar with the surface of the strap exit face 32 to form an impact area 67, enclosed by the bold circle in FIg. 3, to receive the blow of a single knockout pin to remove the tie from the holding cavity block thereby simplifying the block and increasing its service life.

Figure 7:
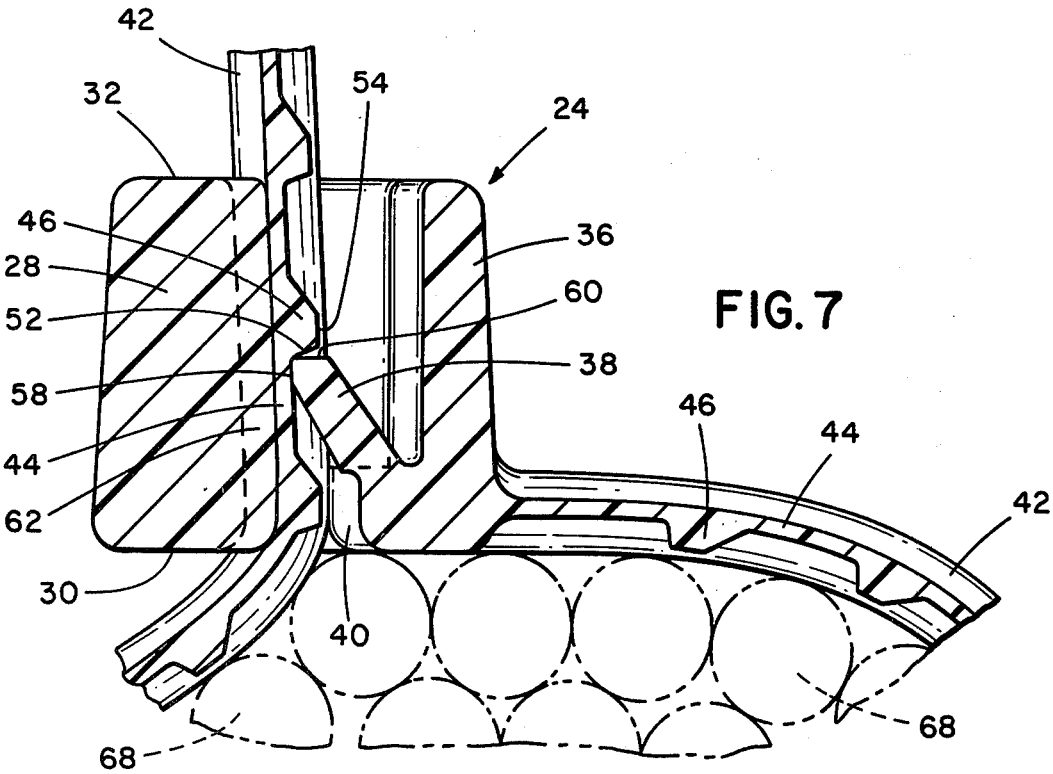
FIG. 7, similar to FIG. 6, shows the pawl lockingly engaging one of the strap teeth.

As shown in FIG. 7, with strap 22 threaded into locking head 24 and the pawl 38 in its locking position, tongue 62 extends between rails 42 to engage and support web 44 thereby preventing the strap from transverse bowing which could cause the tooth to unlock from the pawl.

Operation of tie 20 is as follows: After strap 22 has been disposed about the objects, such as wires 68, to be held, strap free end 26 is threaded through strap receiving aperture 34. As the strap is tightened, the ramp surfaces 50 of teeth 46 sequentially engage pawl 38 camming it to its threading position shown in FIG. 6. Upon release of the strap, the resiliency of the strap and held objects tend to cause the strap to move in the strap-loosening direction. When the abutment surface 52 of the tooth 46 last passing the pawl engages the pawl, the pawl is moved toward its locking position, shown in FIG. 7, wherein tongue 62 engages web 44 and pawl 38 engages both abutment surface 52 of the tooth and the portion of web surface 48 adjoining abutment surface 52. Increased strap withdrawal force causes pawl 38 to more firmly wedge the strap against the abutment wall and the strap to be compressed between the pawl and the abutment wall.

While the cable tie shown in the Figures is of the non-releasable type, it will be appreciated that cable tie 20 could easily be made releasable, for example, by providing a release tab extending from pawl 38 beyond strap exit face 32 and which could be pulled by the user to move the pawl to its threading position.

In view of the above, it will be seen that the several objects of the invention are achieved and other advantageous results attained.

As various changes could be made in the above constructions and methods without departing from the scope of the invention, it is intended that all matter contained in the above description or shown in the accompanyings drawings shall be interpreted as illustrative and not in a limiting sense.

What is claimed is:

1. A one-piece molded thermoplastic tie for forming a plurality of elongate objects into a bundle of generally circular cross-section and for compressively holding a pair of objects together, said tie comprising:

an elongate strap including a pair of longitudinal spaced side rails joined by a web thinner than said rails, said rails and said web being substantially symmetrical about a first plane intersecting said rails and said web and also being substantially symmetrical about a second plane normal to said first plane and intersecting said web, said strap further comprising a plurality of spaced transverse teeth on only one surface of said web and said web having a second surface which is generally flat and substantially parallel to a plane including the crests of said teeth; and a locking head joined to one end of said strap comprising an abutment wall, a strap entry face, a strap exit face, a strap receiving aperture extending between said faces, and a locking pawl which as molded extends from adjacent said entry face, into said aperture, and toward said exit face and said abutment wall for engaging at least one of said teeth, said pawl being movable between a threading position wherein said pawl is out of locking engagement with said strap and a locking position wherein said pawl is disposed adjacent said entry face and is in locking engagement with said strap, said second web surface engaging said abutment wall and said strap being held between said wall and said pawl when said pawl is in its locking position whereby after said strap is disposed about said objects and threaded through said head, attempted retrograde movement of said strap causes said pawl to more firmly engage said strap.

2. A tie as set forth in claim 1 wherein said rails are generally circular in cross-section.

3. A tie as set forth in claim 1 wherein said web has a thickness less than one-quarter the thickenss of said rails.

4. A tie as set forth in claim 1 wherein said web has only sufficient thickness to prevent piercing or tearing thereof by said pawl.

5. A tie as set forth in claim 1 wherein the surface of the web upon which said teeth are disposed is the surface of the web disposed adjacent the objects to be held and wherein said rails extend past the crests of said teeth whereby tooth pressure on the held objects is decreased.

6. A tie as set forth in claim 1 wherein said abutment wall includes a tongue for supporting said web and extending into said aperture toward said pawl, between the side rails of said strap, and into engagement with said web.

7. A tie as set forth in claim 1 wherein the roots of said teeth are disposed substantially along the neutral axis of said strap.

8. A tie as set forth in claim 1 wherein each of said teeth comprises a generally vertical abutment surface and an inclined ramp surface, the abutment surface of one tooth being spaced from the ramp surface of an adjacent tooth by a generally flat surface of said web.

9. A tie as set forth in claim 8 wherein said pawl includes a substantially flat first surface facing said abutment wall and a generally flat second surface facing the locking head exit face and wherein, in its locking position, said pawl engages both the abutment surface of one tooth and said web.

10. A tie as set forth in claim 8 wherein each of said teeth includes a crest surface joining said ramp surface and said abutment surface.

11. A tie as set forth in claim 1 wherein said teeth join said rails.

12. A one-piece molded thermoplastic tie for forming a plurality of elongate objects into a bundle of generally circular cross section and for holding a pair of objects together, said tie comprising:

an elongate strap comprising longitudinally extending spaced side rails, a web joining said rails, and a plurality of spaced transverse teeth disposed on one surface of said web, said rails extending past the other surface of said web; and a locking head joined to one end of said strap comprising side walls, an end wall, an abutment wall joining said side walls, and strap entry and strap exit faces, said walls defining a strap-receiving aperture extending between said faces, said head further comprising a locking pawl for engaging said strap and connected to said end wall adjacent said strap entry face and extending into said aperture and toward said exit face, said abutment wall comprising a tongue extending into said aperture and disposed between said rails and engaging said other surface of said web after said strap has been threaded into said locking head, said tongue extending to said strap exit face and including a surface generally coplanar therewith, said rails and said web being substantially symmetrical about a first plane intersecting said rails and said web and also substantially symmetrical about a second plane normal to said first plane and intersecting said web.

13. A one-piece molded thermoplastic tie for forming a plurality of elongate objects into a bundle of generally circular cross section and for holding a pair of objects together, said tie comprising:

an elongate strap comprising longitudinally extending spaced side rails, a web joining said rails, and a plurality of spaced transverse teeth disposed on one surface of said web, said rails extending past the other surface of said web; and a locking head joined to one end of said strap comprising side walls, an end wall, an abutment wall joining said side walls, and strap entry and strap exit faces, said walls defining a strap-receiving aperture extending between said faces, said head further comprising a locking pawl for engaging said strap and connected to said end wall adjacent said strap entry face and extending into said aperture and toward said exit face, said abutment wall comprising a tongue extending into said aperture and disposed between said rails and engaging said other surface of said web after said strap has been threaded into said locking head, said tongue extending to said strap exit face and including a surface generally coplanar therewith, the roots of said teeth being disposed substantially along the neutral axis of said strap.

14. A one-piece molded thermoplastic self-locking tie for forming a plurality of elongate objects such as wires into a bundle and for holding a pair of objects together, said tie comprising:

an elongate strap including two longitudinal side rails, a web thinner than said rails joining said rails, and a plurality of transverse, longitudinally spaced teeth on only one surface on said web, the roots of said teeth being disposed substantially along the neutral axis of said strap, said web having a generally flat second surface substantially parallel to a plane including the crests of said teeth, and a locking head joined to one end of said strap comprising an abutment wall for engaging said second web surface, a strap entry face, a strap exit face, a strap-receiving aperture extending between said faces, and a locking pawl extending from adjacent said entry face into said aperture toward said abutment wall and said exit face for lockingly engaging one of said teeth whereby the positioning of the strap teeth roots substantially along the strap neutral axis reduces localized stress concentrations in said strap thereby improving the low temperature performance of said tie by decreasing the brittleness of said strap.

15. A tie as set forth in claim 14 wherein said web has only sufficient thickness to prevent piercing or tearing thereof by said pawl.

16. A tie as set forth in claim 14 wherein the surface of the web upon which said teeth are disposed is the surface of the web disposed adjacent the objects to be held and wherein said rails extend past the crests of said teeth whereby tooth pressure on the held objects is decreased.

17. A tie as set forth in claim 14 wherein said abutment wall includes a tongue for supporting said web and extending into said aperture toward said pawl, between the said rails of said straps, and into engagement with said web.

18. A tie as set forth in claim 14 wherein adjacent teeth are spaced by a generally flat surface of said web.

19. A tie as set forth in claim 6 wherein both said rails and said web are supported substantially along the entire length of their extension through said locking head by said abutment wall.

* * * * *